US008286602B2

(12) United States Patent
Kameda et al.

(10) Patent No.: US 8,286,602 B2
(45) Date of Patent: Oct. 16, 2012

(54) PHASE VARIABLE DEVICE IN CAR ENGINE

(75) Inventors: Michihiro Kameda, Hadano (JP); Masayasu Nagadoh, Hadano (JP)

(73) Assignee: Nittan Valve Co., Ltd., Hadano-shi (JP)

( * ) Notice: Subject to any disclaimer, the term of this patent is extended or adjusted under 35 U.S.C. 154(b) by 251 days.

(21) Appl. No.: 12/811,634

(22) PCT Filed: Feb. 4, 2008

(86) PCT No.: PCT/JP2008/051763

§ 371 (c)(1),
(2), (4) Date: Aug. 9, 2010

(87) PCT Pub. No.: WO2009/098752

PCT Pub. Date: Aug. 13, 2009

(65) Prior Publication Data

US 2010/0313836 A1 Dec. 16, 2010

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/160
See application file for complete search history.

(56) References Cited

U.S. PATENT DOCUMENTS 7,497,193 B2 * 3/2009 Knecht et al. ..... 123/90.17

FOREIGN PATENT DOCUMENTS

| | | | |
|---|---|---|---|
| JP | 2005-113755 | A | 4/2005 |
| JP | 2007-071241 | A | 3/2007 |
| JP | 2007-071261 | A | 3/2007 |
| JP | 3948995 | B2 | 7/2007 |

OTHER PUBLICATIONS

International Search Report of PCT/JP2008/051763, Mailing Date of May 13, 2008.

* cited by examiner

*Primary Examiner* — Ching Chang
(74) *Attorney, Agent, or Firm* — Westerman, Hattori, Daniels & Adrian, LLP

(57) ABSTRACT

A phase variable device for use with a car engine, capable of preventing the phase angle of the camshaft from varying relative to the first circular rotational body. The device includes: a first rotational body, an intermediate rotational bode integral with the camshaft of an engine, a second rotational body, all rotatably arranged on the same camshaft, the device adapted to control phase angle of the second rotational body, thereby varying the phase angle of the intermediate rotational body. The second rotational body is placed in substantial contact with the inside of the hollow cylindrical section of the intermediate rotational body. A circular eccentric cam, integral with the second rotational body and adapted to rotate about an eccentric center thereof, causes a cam guide plate to reciprocate in the direction perpendicular to the rotational axis.

2 Claims, 14 Drawing Sheets

PHASE VARIABLE DEVICE IN CAR ENGINE

TECHNICAL FIELD

This invention relates to a phase variable device for controlling opening/closing timing of a valve of a car engine by applying a torque to a rotatable drum so as to change the rotational phase angle of the camshaft relative to the sprocket of the engine.

BACKGROUND ART

A conventional valve timing control device of this type is disclosed in Patent Document 1 below. This valve timing device has: a drive plate 3 rotatablly mounted on a camshaft 1 subjected to the driving force transmitted thereto from the engine crankshaft 1; a driven shaft member 9 directly mounted on the camshaft 1 and having a conversion guide 11 which is mounted on the circumference of the camshaft 1 and spaced apart from the front face of the drive plate 3; and an intermediate rotational body 5 which is rotatably mounted forwardly of the conversion guide 11 on the driven shaft member 9 via a shaft bearing 14.

The drive plate 3 has radial guides 10, while the driven shaft member 9 has guides 12 which are skewed with respect to the circumference thereof. The intermediate rotational body 5 has a spiral guide 15. Each of the guides 10, 12, 15 is configured in the form of a groove. Each of the skewed guides shares a spherical body 16 with one radial guide 10 and the spiral guide 15 such that the spherical body 16 engages the respective guides. The intermediate rotational body 5 can rotate relative to the driven shaft member 9 when a yoke block 19 coupled with the intermediate rotational body 5 is magnetized by the magnetic field generated by a pair of electromagnetic coils 22*a* and 22*b*.

In the device of the cited Patent Document 1, when the intermediate rotational body 5 is rotated relative to the driven shaft member 9 in the direction of delayed phase angle (the direction hereinafter referred to as angularly retarded direction, and the opposite direction referred to as angularly advanced direction), the spherical body 16 rolls in the spiral guide 15 so that it is inwardly displaced in the radial guides 10 in the form of grooves, thereby effecting cam actions on the conversion guide 11. As a consequence, the coupling angle between the drive plate 3 and driven shaft member 9 integral with the camshaft 1 is varied to the angularly most advanced angle. On the other hand, as the intermediate rotational body 5 is rotated by a magnetic force the angularly advanced direction with respect to the driven shaft member 9, the spherical bodies 16 will roll in the respective guide grooves 15, 10, and 11 in the opposite direction, thereby effecting reverse cam action on the conversion guide 11. As a consequence, the coupling angle between the drive plate 3 and driven shaft member 9 is altered to an advanced phase angle. PATENT DOCUMENT 1: JP No. 3948995

DISCLOSURE OF INVENTION

Objects of the Invention

The camshaft of an engine is continually subjected to reactive impulses of valve springs during driving. In the device of the cited Patent Document 1, such reactive impulses are transmitted to the spherical bodies 16 via the guides 12 formed in the conversion guide 11 of the driven shaft member 9. As a consequence, the spherical bodies 16 are rolled in the guide bores 12, thereby failing maintaining a constant coupling angle of the drive plate 3 and camshaft 1. Such unintended change in the coupling angle in turn causes problematic errors in intake valve timing/exhaust valve timing.

On the other hand, in the device of the cited Patent Document 1, when the coupling angle between the drive plate 3 and driven shaft member 9 (or camshaft 1) is maximized, each of the spherical bodies 16 rolls from one end of the respective guide 12 and stops at the other end by collisding the other end. However, in the event that the speed of the colliding spherical bodies 16 is high, the collisions cause undesirable vibrations in the engine, which makes it difficult to control the rolling speed of the spherical bodies 16 by controlling the intensity of the magnetic field.

In order to overcome such problem pertinent to the prior art as mentioned above, the present invention provides a phase variable device capable of preventing unexpected change in the coupling angle between the first rotational body (drive plate 3 rotated by the crankshaft) and the camshaft from occurring if a reactive impulse is transmitted from valve springs to the camshaft, thereby capable of maintaining a constant coupling angle. The device is designed to reduce the impulses caused by spherical bodies and pins hitting the ends of the guides, particularly when the range of variable phase angle is set to a maximum.

Means for Solving the Problems

In order to achieve the above mentioned objects, there is provided a phase variable device for use with a car engine as recited in claim 1, the phase variable device having a phase angle varying mechanism which includes:

- a first rotational body driven by the crankshaft of the engine;
- an intermediate rotational body integral with the camshaft of the engine;
- a second rotational body arranged forwardly of the intermediate rotational body; and
- torque means, arranged between the first and second rotational bodies, for providing the second rotational body with a torque to rotate the second rotational body relative to the first rotational body to change the phase angle of the first rotational body relative to the second rotational body,
- all the three bodies being coaxial with the same rotational axis and each being capable of undergoing relative rotational motion with respect to others, the phase angle varying mechanism is characterized in that:

- the intermediate rotational body has a hollow cylindrical portion;
- the second rotational body is disk-shaped and has substantially the same diameter as the inner diameter of the cylindrical portion of the intermediate rotational body, and is in contact with the inside of the cylindrical portion, the phase angle varying mechanism is characterized by further comprising:

- a circular eccentric cam having a central axis offset from the rotational axis of the second rotational body and protruding in the direction from the second rotational body to the intermediate rotational body;
- an oblong bore extending in the direction perpendicular to the rotational axis of the second rotational body to allow the circular eccentric cam to slide therein;
- a cam guide plate having sliding members that extend therefrom towards the first rotational body and intermediate rotational body;

a pair of radial guides formed in the intermediate rotational body, each extending in the direction perpendicular to the longest diameter of the oblong bore of the cam guide plate; and skewed guides formed in the first rotational body, the guides skewed at an angle to the circumferential envelope of the first rotational body centered at the rotational axis of the first rotational body, so that the sliding members of the cam guide plate can move in the radial guides and the respective skewed guides.

(Function 1)

When the second rotational body is braked by the torque means, it becomes delayed in rotational motion relative to the first rotational body. The circular eccentric cam reciprocates in the oblong bore of the cam guide plate, acting a force on the inner face of oblong bore in the direction perpendicular to the longest axis of the oblong bore while sliding on the inner face of the oblong bore. As the slide member moves in the radial guides of the intermediate rotational body, the cam guide plate reciprocates in the direction perpendicular to the longest diameter of the oblong bore, that is, in the radial direction of the intermediate rotational body. On the other hand, the slide members are then displaced along the skewed guides which are skewed with respect to the circumference of the first rotational body. Accordingly, under the reactive cam action of the skewed guides, the cam guide plate is moved relative to the first rotational body, in the radial direction as well as in the direction of the circumference of the first rotational body It is noted that the relative motion of the intermediate rotational body in the circumferential direction of the cam guide plate, relative to the cam guide plate, is prohibited. As a consequence, the intermediate rotational body is united with the cam guide plate to undergo a move in the circumferential direction of the first rotational body. As a result, the phase angle of the intermediate rotational body driven by the camshaft relative to the first rotational body driven by the crankshaft is changed.

On the other hand, when the camshaft is acted upon by a reactive force of the valve spring, the intermediate rotational body is acted upon by a torque from the camshaft, which torque tends to displace the intermediate rotational body relative to the first rotational body and the cam guide plate. Due to the cam action of the skewed guides arising from the torque, the slide members of the cam guide plate, and hence the cam guide plate, are acted upon by forces that drive them in the direction perpendicular to the longest diameter of the oblong bore (the direction referred to as perpendicular direction). These forces exerted on the cam guide plate in turn acts on the second rotational body in the above mentioned perpendicular direction at the point where an axis passing through the central axis of the circular eccentric bore of the second rotational body and crossing the longest diameter of the oblong bore at a right angle, meets the inner circumference of the eccentric bore.

In addition, since the outer periphery of the second rotational body is in substantial contact with the inner surface of the cylindrical member of the intermediate rotational body (rotatable guide plate), the force exerted on the cam guide plate and urging it in the perpendicular direction in turn acts on the intermediate rotational body at the point where the axis, parallel to a line intersecting the longest diameter of the oblong bore at a right angle passing through the rotational axis of the circular eccentric bore of the second rotational body, meets the inner cylindrical face of the cylindrical member of the intermediate rotational body that accommodates therein the second rotational body. It is noted that a local frictional force is generated at that point, stopping the sliding motion of the second rotational body on the intermediate rotational body.

Thus, when the camshaft is acted upon by a reaction of valve spring, the second rotational body is locked immobile relative to the intermediate rotational body by the local frictional force, so that the circular eccentric cam cannot undergo any eccentric motion, which in turn causes the slide members of the cam guide plate to be locked in the skewed guides of the first rotational body. As a consequence, since the intermediate rotational body coupled to the camshaft is then held immobile relative to the first rotational body, the phase angle of the intermediate rotational body will not be changed relative to the first rotational body if a torque occurs in the camshaft in response to the reaction of the valve spring.

(Function 2)

On the other hand, the intermediate rotational body can assume a maximum allowable phase angle relative to the first rotational body when the outer periphery of the cam guide plate comes into abutment with the cylindrical surface of the intermediate rotational body of the intermediate rotational body and stops there after the cam guide plate, which had been in contact with the cylindrical surface, moved away once from there radially inwardly and the outer circumference came off the circumference of the cylindrical surface. The speed of the speed of the cam guide plate in the direction perpendicular to the longest diameter of the oblong bore changes in the same manner as that of the circular eccentric cam in that direction.

The movement of the circular eccentric cam in the direction perpendicular to the longest diameter of the oblong bore of the cam guide plate during a rotation about the rotational axis turns out to be a simple harmonic oscillation. The amplitude $\delta$ of the oscillation is equal to the distance between the center of the circular eccentric cam and the rotational axis of the second rotational body. Thus, the speed of the circular eccentric cam moving in the direction perpendicular to the longest diameter of the oblong bore increases as the center of the circular eccentric cam approaches the rotational axis, and decreases as the center moves away from the rotational axis. In fact the speed becomes zero when the distance between the center of the circular eccentric cam and the rotational axis is $\delta$ (maximum), irrespective of the rotational speed of the circular eccentric cam.

Accordingly, in arranging the cam guide plate to abut against the cylindrical surface of the intermediate rotational body, it is possible to decelerate the speed of the outer periphery of the cam guide plate colliding the cylindrical face of the intermediate rotational body by setting the distance between the center of the circular eccentric cam and the rotational axis of the second rotational body as close possible to the amplitude $\delta$. Because of this deceleration of the outer periphery, the impulse of the outer periphery of the cam guide plate onto the cylindrical face of the intermediate rotational body is alleviated even if the phase angle between the camshaft and the intermediate rotational body (and hence the rotatable guide plate) is maximized.

In order to achieve the above mentioned objects, the phase variable device of claim 1 may be provided in a manner as recited in claim 2, wherein the second rotational body has a circular eccentric bore with its center offset from the rotational axis of the second rotational body;

the circular eccentric cam comprises a first circular eccentric cams ((53)) adapted to be in sliding contact with the oblong bore ((56)) of the cam guide plate ((37)) and a second circular eccentric cam ((54)) formed adjacent to the first circular eccentric cam ((53)) and adapted to engaged the circular eccentric bore ((52));

the second circular eccentric cam ((54)) is configured to have a central axis offset from the rotational axis of the second rotational body ((35)) by a distance less than the distance between the axes of the first circular eccentric cam and the second rotational body ((35)).

(Function)

When a torque is imparted from the camshaft ((30)) to the intermediate rotational body ((33)), the local frictional force that takes place between the second rotational body ((35)) and the intermediate rotational body ((33)) can be enhanced by reducing the eccentric distance between the center of the second circular eccentric cam ((36)) and the rotational axis of the second rotational body ((35)), and by enhancing the force exerted by the intermediate rotational body ((33)) onto the second rotational body ((35)). On the other hand, the travel distance of the cam guide plate relative to the intermediate rotational body 33 is increased by increasing the distance between the first circular eccentric cam ((36)) and the rotational axis of the second rotational body ((35)). That is, both the frictional force between the second rotational body ((35)) and the intermediate rotational body ((33)) and the relative travel distance of the cam guide plate ((37)) are simultaneously increased by changing the eccentric distance from the rotational axis L1 of the second rotational body to the first and second eccentric cams.

Results of the Invention

In the invention defined in claim 1, if a torque is transmitted from the camshaft ((30)) in operation to the intermediate rotational body ((33)) which causes a delay in phase angle of the camshaft relative to the first rotational body, self-lock effect is evoked in response to the torque to stop the relative rotation of the intermediate rotational body ((33)) relative to the first rotational body ((31)) via the cam guide plate ((37)). Accordingly, no unexpected phase angle change will occur between the camshaft ((30)) and the first rotational body ((31)), thereby maintaining accurate opening/closing timing of valves.

It should be noted that the phase variable device defined in claim 1 can suppress the impulse of the cam guide plate ((37)) against the cylindrical face of the intermediate rotational body ((33)) to a great degree, independently of the rotational speed of the circular eccentric cam ((36)). It should be also noted that, should an abrupt maximum phase-angle change take place between the camshaft ((30)) (or intermediate rotational body) and the first rotational body ((31)), the engine is subjected to a least impulse.

On the other hand, the phase variable device of claim 2 can maintain the relative phase angle of the cam guide plate relative to the intermediate rotational body as it is. In addition, the device can enhance the self-lock effect so as to prevent the relative rotation of the intermediate rotational body relative to the first rotational body when a torque is applied by the camshaft to the intermediate rotational body. Thus, an unexpected change in phase angle of the intermediate rotational body relative to the first rotational body can be prevented. Thus, accurate open/close timing of intake/exhaust valves is secured.

BEST MODE FOR CARRYING OUT THE INVENTION

The invention will now be described in detail by way of example with reference to accompanying drawings.

FIGS. 1 through 18 show a first and a second embodiment of the phase variable device in accordance with the present invention.

FIG. 1 is an exploded perspective view of a phase variable device for use with a car engine in accordance with the first embodiment of the invention.

FIG. 2 is a front view of the first phase variable device of FIG. 1.

FIG. 3 shows an axial cross section of the first phase variable device taken along line A-A of FIG. 2.

FIG. 4 shows a vertical cross section of a second rotational body and a rotational guide plate (or intermediate rotational body) taken along line B-B of FIG. 3.

FIG. 6 shows a vertical cross section of a first rotational body taken along line D-D of FIG. 3.

FIG. 7 is a diagram illustrating a relationship between the second rotational body and a circular eccentric cam.

FIG. 8 illustrates the circular eccentric cam in operative contact with the cam guide plate.

FIG. 9 illustrates the first rotational body in operative contact with guide pins (or slide members).

FIGS. 10(*a*) through (*c*) show different specifications of the circular eccentric cam in oscillatory movement on a rotational plane.

FIG. 11 is a diagram showing the amount of displacement of a slide member as a function of the angular position of the circular eccentric cam.

FIGS. 12(*a*) and (*b*) show details of a self-lock mechanism involving the second rotational body and the rotational guide plate.

FIG. 13 is an exploded perspective view of a phase variable device for use with a car engine in accordance with the second embodiment of the invention.

FIG. 14 shows an axial cross section of the second phase variable device.

FIG. 15 is a perspective view of the second phase variable device, partly cut away to show a partial cross section of the device.

FIG. 16 is a diagram showing the structure of the second and third rotational bodies of the second phase variable device.

FIG. 17 is a diagram showing the arrangement of the circular eccentric cam and cam guide plate in association with the intermediate rotational body.

FIGS. 18(*a*) to (*d*) show views of a modification of the cam guide plate.

Being coupled with an engine, a phase variable devices as shown in the first and second embodiments is integrally mounted on an engine. The device transmits the rotational motion of the crankshaft of the engine to the camshaft 30 to open/close the intake/exhaust valves in synchronism with the rotation of the crankshaft while controlling opening/closing timing of the valves in accord with the operational conditions, e.g. engine load and rpm of the engine.

As shown in FIGS. 1 through 6, this device is provided with:

a freely rotatable first rotational body (which is a rotational body driven by the crankshaft) 31 driven by the crankshaft (not shown) of an engine;

a center shaft 32 which is integral with, and hence rotated by, the camshaft 30;

an intermediate rotational body 33 (acting as the guide plate of the second rotational body 35) fixed to the center shaft 32 and rotatable together with the camshaft 30 relative to the first rotational body 31;

a second rotational body (control rotator) 35 which is rotatably mounted on the front end of the center shaft 32 such that it can be braked by an electromagnetic clutch 34, all coaxial with the same rotational axis L1.

Moreover, the device has:

a circular eccentric cam 36 adapted to undergo eccentric rotation about the rotational axis L1 when the second rotational body 35 is in rotation; a cam guide plate 37 which is forced by the circular eccentric cam 36 to undergo reciprocal motion relative to the intermediate rotational body 33, in the direction perpendicular to the axis L1;

and slide pins (slide members) 40 protruding from the cam guide plate 37 so as to be displaced within the radial guides 38 of the intermediate rotational body 33 and in the skewed guides 39 of the first rotational body 31.

In this arrangement, the leading end 30*a* of the camshaft 30 is placed in engagement with the bore 32*a* of the center shaft 32. Rotatably mounted on, and at the front side of, the cylindrical portion of a flange 32*b* formed on the outer circumference of the center shaft 32 is the first rotational body 31 that has a sprocket 41. Also rotatably mounted on, and at the rear side of, the cylindrical portion of the flange 32*b* is a second sprocket member 42. The first rotational body 31 and the second sprocket member 42 are coupled by a multiplicity (which is six in the example shown herein) of coupling pins 43.

The center shaft 32 has a flat engaging surface 32*c*, to which a square bore 33*b* of the intermediate rotational body 33 is immovably fitted, thereby securely fixing the intermediate rotational body 33 on the center shaft 32. The intermediate rotational body 33 has a cylindrical shape. Formed in the bottom end of the intermediate rotational body 33 are the square bore 33*b*, the radial guides 38, and engagement bores 48 through 51 for engagement with the guide pins 44 through 47. A pair of radial guides 38 in the form of elongate grooves, symmetrical with respect to the rotational axis L1, extend along the axis perpendicular to the axis L1. The engagement bores 48 and 49 are formed such that the straight line passing through their centers is parallel to the longitudinal direction of the radial guides 38. The same is true for the engagement bores 50 and 51.

Arranged inside the cylindrical portion 33*c* of the intermediate rotational body 33 are the second rotational body 35, circular eccentric cam 36, cam guide plate 37, and multiple slide pins 40 in engagement with the cam guide plate 37. The second rotational body 35 has a circular eccentric bore 52 with its central axis L2 being offset by a distance d1 from the rotational axis L1.

The circular eccentric cam 36 comprises a first circular eccentric cam 53 and a second circular eccentric cam 54, which are integral with each other and coaxial with the rotational axis L1. The circular eccentric cam 36 has a circular bore 55 which is coaxial with the axis L1, and is rotatably mounted on the leading end of the cylindrical portion 32*d* of the center shaft 32 penetrating the circular bore 55. By arranging the circular eccentric cam 54 in engagement with the circular eccentric bore 52, the second rotational body 35 is held freely rotatable relative to the center shaft 32. The second rotational body 35 is a circular disk having substantially the same diameter as the inner diameter of the cylindrical portion 33*c* of the rotational body 33, and has an outer circumferential surface 35*a* to be in substantial contact with the inner circumferential face 33*d* of the cylindrical portion 33*c*. The center of the first circular eccentric cam 53 is offset by a distance d2 from the rotational axis L1, wherein the distance d2 is larger than the distance d1 between the central axis L2 of the second circular eccentric cam 54 and the rotational axis L1. Incidentally, the outer configurations of the circular eccentric cams 53 and 54 are not limited to circular shapes as in the examples shown herein. They can have different circumferential configurations.

The rotational guide plate 37 has a pair of engagement holes 37*a*, and an oblong bore 56 for slidably accommodating the first circular eccentric cam 53. The pair of engagement holes 37*a* are formed at symmetrical positions with respect to a line perpendicular to the axis L1, and separated apart from each other by the same distance as the distance between the two radial guides 38. The slide pins 40 engage the engagement holes 37*a* and protrude therethrough towards the intermediate rotational body 33. The oblong bore 56 is formed to have the longest diameter perpendicular to the longitudinal direction of the radial guides 38. Accordingly, the longest diameter of the oblong bore 56 passes through the axis L1, and is perpendicular to the straight line connecting the centers of the paired engagement holes 37*a*. The height of the oblong bore 56 is approximately the same as the external diameter of the first circular eccentric cam 53, so that the first circular eccentric cam 53 fitted in the oblong bore 56 in slidable contact with the inner periphery of the oblong bore 56 can freely slide in the oblong direction. Formed on the opposite sides of the rotational guide plate are one abutment face 37*b* for abutment with guide pins 44 and 45 and another abutment face 37*c* for abutment with guide pins 46 and 47.

The slide pins 40 are inserted in the radial guides 38 of the intermediate rotational body 33, and engage the skewed guides 39 formed in the first rotational body 31. The skewed guides 39 are grooves which are skewed with respect to a circle centered at the rotational axis L1, wherein the radii of the grooves decrease or increase at a predetermined rate in proportion to the rotational angle of the first rotational body 31. In the examples shown herein, a pair of grooves are formed symmetrically with respect to the rotational axis L1.

Arranged forwardly of the second rotational body 35 and adjacent the engine casing (not shown) of the engine is an electromagnetic clutch 34 for magnetically attracting the second rotational body 35 when a coil 34*a* is activated. Fitted inside the electromagnetic clutch 34 is a spring holder 58 provided on the outer circumference thereof with a torsion coil spring 57. The leading end of the holder engages the recess 32*e* of the center shaft 32. A female screw hole is formed in the camshaft 30. By screwing a bolt 60 in the female screw hole formed in the camshaft 30, the spring holder 58, center shaft 32, and camshaft 30 are tightly coupled together so that they can rotate together about the axis L1. The rear end 58*a* of the spring holder 58 faces the front end of the second circular eccentric cam 53 which is spaced apart from the spring holder 58*a*. The rear end 58*a* prevents the circular eccentric cam 36 and cam guide plate 37 from dropping off in the forward direction. One end 59*a* of a torsion coil spring 59 is fixed in the hole 35*b* of the second rotational body 35, and the other end 59*b* is fixed in the hole 58*b* of the spring holder 58, in such a way that the spring urges the second rotational body 35 against braking torque of the electromagnetic clutch 34 acting on the second rotational body 35 (that is, in the direction opposite to the rotational direction of the first rotational body 31).

Referring to FIGS. 7 through 10(*a*), operation of the phase control device in accordance with the first embodiment will now be described below. In the first embodiment, the first circular eccentric cam 53 and cam guide plate 37 are arranged in position relative to the inner circumferential face 33*d* of the intermediate rotational body 33 as shown in FIG. 10(*a*). This is to change the phase angle of the intermediate rotational body 33 relative to the first rotational body 31 from its initial angular position (having no phase difference) to an angularly advanced position, that is, in the direction that matches the rotation direction of the first rotational body 31 shown in FIG. 7, which is the clockwise direction when viewed from the front end of the device. As seen in the figures, under the initial condition, the cam guide plate 37 is arranged such that the upper end 37*d* thereof is in contact with the upper portion of the inner circumference 33*d* of the intermediate rotational body 33, while the circular eccentric cam 53 is arranged such that its central axis L3 (passing through its eccentric center) is inclined counterclockwise with respect to the upward longitudinal axis L4 of the radial guides 38. Initially, the electromagnetic clutch 34 is not energized, and the second rotational body 35 and the second circular eccentric cam 54 of the circular eccentric cam 36 are acted upon by a clockwise torque due to the biasing force of the torsion coil spring 59. Under this condition, the upper end 37*d* of the cam guide plate 37 is forced against the inner circumferential face 33*d* and fixed to the intermediate rotational body 33.

Under such initial condition as described above, where the cam guide plate 37 is fixed to the intermediate rotational body 33, the intermediate rotational body 33 and the second rotational body 35 will rotate together in the clockwise direction when the first rotational body 31 is rotated by the crankshaft in the clockwise direction.

In order to change the phase angle between the first rotational body 31 and the camshaft 30, the electromagnetic clutch 34 is energized. Then, the second rotational body 35 is attracted by the electromagnetic clutch 34 and becomes delayed in rotation, that is, the second rotational body 35 is rotated counterclockwise relative to the first rotational body 31, so that the second circular eccentric cam 54 rotates counterclockwise. The first circular eccentric cam 53, coupled with the second circular eccentric cam 54, slides on the inner circumferential face of the oblong bore 56 of the cam guide plate 37 and reciprocates in the direction perpendicular to the radial guides 38, thereby acting a force on the cam guide plate 37 along the radial guides 38. Thus, the slide members 40 are displaced along the radial guides 38 of the intermediate rotational body, and the abutment faces 37*b* and 37*c* are slidably displaced with respect to the guide pins 44 through 47, so that the cam guide plate 37 descends along the elongate radial guides 38.

On the other hand, since the slide pins 40 are then displaced in the skewed guides 39 of the first rotational body 31, the cam guide plate 37 is rotated clockwise with respect to the first rotational body 31 while it is moving downward. Since the intermediate rotational body 33 cannot rotate relative to the cam guide plate 37 on account of the guide pins 44 through 47, the intermediate rotational body 33 becomes coupled with the cam guide plate 37 and rotates clockwise relative to the first rotational body 31. The relative rotation of the intermediate rotational body 33 stops when the torque generated by the torsion coil spring 59 for causing clockwise rotation of the second rotational body 35 is equilibrated with the torque generated by the electromagnetic clutch 34 for causing the counterclockwise rotation of the second rotational body 35. The relative rotation of the intermediate rotational body 33 comes to an end, before the torque generated by the torsion coil spring 59 balances the torque generated by the electromagnetic clutch 34, when the lower end 37*e* of the outer circumference of the cam guide plate 37 abuts on the inner circumferential face 33*d* of the intermediate rotational body 33. As a result, the phase angle of the camshaft 30 (coupled with intermediate rotational body 33) changes, in the angularly advanced direction, relative to the first rotational body 31 driven by the crankshaft. The relative rotation of the intermediate rotational body 33 assumes a maximum phase angle when the lower end 37*e* of the cum guide plate 37 comes into contact with the lower portion of the inner circumferential face 33*d* to completes the relative rotation.

On the other hand, when the current level of the electromagnetic clutch 34 is reduced to decrease braking of the second rotational body 35, the second rotational body 35 will undergo a clockwise rotation (FIG. 7) due to the torque caused by the force of the spring 59 relative to the intermediate rotational body 33, which in turn results in a rise of the cam guide plate 37 and causes the intermediate rotational body 33 to be angularly displaced counterclockwise relative to the first rotational body 31. The relative rotation of the intermediate rotational body 33 ends as the torque generated by the torsion coil spring 59 and the torque generated by the electromagnetic clutch 34 balance again. When the electromagnetic clutch 34 is turned off, the above mentioned relative rotation continues until the initial condition is restored where the upper end 37*d* of the outer circumference of the cam guide plate 37 abuts against the inner circumferential face 33*d* of the intermediate rotational body 33.

FIGS. 10(*b*) and (*c*) illustrate two other examples in which the first circular eccentric cam 53 and cam guide plate 37 have different arrangements with respect to the inner circumferential face the intermediate rotational body 33 as compared with the example shown in 10(*a*). FIG. 10(*b*) particularly shows an example in which the phase angle of the intermediate rotational body 33 can be delayed behind its initial phase angle relative to the first rotational body 31. FIG. 10(*c*) particularly shows an example in which the phase angle of the intermediate rotational body 33 relative to the first rotational body 31 can be first advanced from the initial phase angle and then later delayed by continually effecting the braking by the electromagnetic clutch 34.

In the arrangement of FIG. 10(*b*), the cam guide plate 37 is lifted upward when the phase angle is changed, in contrast to the device shown in FIG. 10(*a*) where the cam guide plate 37 is lowered. Under the initial condition, the cam guide plate 37 has its lowest end 37*e* abutting against the lower most portion of the inner circumferential face 33*d* of the intermediate rotational body 33, so that the central axis L3 (passing through the eccentric center) of the first circular eccentric cam 53 is inclined at an angle with respect to the longitudinal axis L4 of the radial guides 38. In the arrangement of FIG. 10(*a*) the slide pins 40 are initially arranged at positions 39*a* and 39*b* of the skewed guide 39 (FIG. 9) but in the arrangement of 10(*b*) the slide pins 40 are arranged at positions 39*c* and 39*d*. In this arrangement, if the electromagnetic clutch 34 is energized during the operation, the cam guide plate 37 rises upward from its initial position, and the intermediate rotational body 33 tends to delay with respect to the first rotational body 31, resulting in a delay in phase angle of the intermediate rotational body 33. Such angular delay becomes maximum when the relative rotation ends as the upper end 37*d* of the cam guide plate 37 comes to abut against the upper portion of the inner circumferential face 33*d* of the intermediate rotational body 33, where the delay becomes maximum.

In the arrangement of FIG. 10(*c*), the first circular eccentric cam 53 is initially arranged such that the major axis L3 passing through its eccentric center is inclined counterclockwise with respect to the axis L5 perpendicular to the longitudinal direction of the radial guides 38. It is noted that the intermediate rotational body 33 is provided at the upper portion of the inner circumferential face 33*d* with a flat area 33*e*, and that the upper end 37*d* of the cam guide plate 37 abuts against the flat area 33*e*. Moreover, the lower end 37*e* of the cam guide plate 37 is arranged not to contact the inner circumferential face 33*d* of the intermediate rotational body 33 while the first circular eccentric cam 53 is in rotation. The slide pins 40 are initially arranged at positions 39*a* and 39*b* of the skewed guides 39 as shown in FIG. 9. In this arrangement, when the electromagnetic clutch 34 is energized during the rotation of the crankshaft, the first circular eccentric cam 53 is rotated counterclockwise from its initial angular position, the cam guide plate 37 descends from its initial position, and accordingly the phase angle of the intermediate rotational body 33 advances relative to the first rotational body 31 until the lower end 37*e* comes into contact with the axis L4. On the other hand, after the lower end 37*e* has passed the axis line L4, the movement of the cam guide plate 37 is reversed to go upward until the upper end 37*d* thereof reaches the flat area 33*e* while changing the relative phase angle in the angularly delayed direction. It should be understood that, alternatively, a flat area on which the cam guide plate 37 can abut may be provided at the lower portion of the intermediate rotational body 33, and that the central axis L3 passing through the eccentric center may be initially inclined counterclockwise with respect to the axis L5 while the slide pins 40 may be arranged at positions 39*c* and 39*d* of the skewed guides 39 (FIG. 9). In this case, the phase angle of the intermediate rotational body 33 delays once and then advances relative to the first rotational body 31.

Together with FIGS. 10(*a*), (*b*), FIG. 11 shows how the speed of the cam guide plate 37 changes along the radial guides 38 as it slides on the inside of the intermediate rotational body 33. The ordinate of the graph shown in FIG. 11 represents the distance from the point, where the upper end 37*d* (or 37*e* in FIG. 10(*b*)) initially abuts against the inner circumferential face 33*d* of the intermediate rotational body 33, to the slide pins 40, while the abscissa represents the angle of rotation of the first circular eccentric body 53 with respect to the upward axis L4 (or downward axis in FIG. 10(*b*)). In the first embodiment, "STARTING POSITION" of FIGS. 10(*a*), (*b*) and FIG. 11 refers to the initial position of the cam guide plate 37 with its upper end 37*d* being in contact with the upper portion of the inner circumferential face 33*d* of the intermediate rotational body 33, while "END POSITION" refers to the end position of the cam guide plate 37 where the lower end 37*e* of the cam guide plate 37 stops with its lower end 37*e* being in contact with the lower portion of the inner circumferential face 33*d*. The "END POSITION" corresponds to the maximum angular phase variation that the intermediate rotational body can assume. The "STARTING POSITION" and "END POSITION" in FIG. 10(*b*) are reversed with respect to the "STARTING POSITION" and "END POSITION" of FIG. 10(*a*).

In FIG. 11, the slope of the curve represents incremental moving distance of a slide pin 40 per unit angle. As shown in FIG. 11, the slope of the curve becomes less steep near the beginning and end of the rotation of the circular eccentric cam 53, implying that the acceleration/deceleration near the starting/end position is gradual. That is, the speed of the slide pin 40 moved by the circular eccentric cam 53 varies in accordance with a sine curve. Accordingly, if the circular eccentric cam 53 is employed, the collision speed of the cam guide plate 37 with respect to the inner circumferential face 33*d* of the intermediate rotational body 33 slows down near the starting and end positions. As a result, impulsive noise caused by the collision of the slide pins is always reduced.

On the other hand, since the radial distance of the skewed guides 39 from the rotational axis changes with the angle of rotation of the first rotational body 31 at a constant rate, the speed of the intermediate rotational body 33 relative to the first rotational body 31 changes in the same manner as the cam guide plate 37 during its reciprocal motion. As a consequence, the speed of the camshaft 30 relative to the first rotational body 31 becomes slower at the starting position and the end position (where the maximum angular displacement is allowed for the intermediate rotational body), so that the impulse delivered to the engine due to the change in cam torque will be reduced. It is noted in this example that, by varying the radii of the skewed guides 39 with the rotational angle of the first rotational body 31, it is possible to add linearity to the rate of change in phase angle of the camshaft 30 with rotational angle of the first rotational body, and/or delay the speed of the cam shaft 30 relative to the first rotational body 31 by decreasing the rate of change in radii of the skewed guides, especially in the range of most frequently used phase angle.

Next, referring to FIGS. 12 (*a*) and (*b*), the self-lock mechanism of the invention will now be described. This self-lock mechanism is directed to prevent phase angle misalignment between the first rotational body 31 and the intermediate rotational body 33 from occurring when the intermediate rotational body 33 is acted upon by a torque of the camshaft 30. When the camshaft 30 is acted upon by a reaction of the valve spring (not shown), the intermediate rotational body 33 is acted upon by a torque from the from the camshaft 30, which causes the intermediate rotational body 33 to be displaced from the first rotational body 31 and the cam guide plate 37. FIGS. 12(*a*) and (*b*) show the clockwise torque generated by the camshaft 30. The cam guide plate 37 is then urged in the longitudinal direction of the radial guides 38, and the first circular eccentric cam 53 is forced in the longitudinal direction of the radial guides 38 at the point where it abuts against the oblong bore 59 when the slide pins 40 are acted upon by cam actions of skewed guides 39. On the other hand, the second rotational body 35 is acted upon by a force from the second circular eccentric cam 54 in the longitudinal direction of the radial guides 38 at the point P1 where the axis L6, which is parallel to the axis L4 of the second rotational body 35 and passes through the central axis L2 of the second circular eccentric cam 54, crosses the inner circumferential face of the circular eccentric bore 52 of the second rotational body 35.

Further, since the outer circumferential face 35*a* is in substantial contact with the inner circumferential face 33*d* of the cylindrical portion 33*c* of the intermediate rotational body 33, the force acting on the cam guide plate 37 in the longitudinal direction of the radial guides 38 acts on intermediate rotational body 33 at point P2 where the axis L6 crosses the inner circumferential face 33*d* of the intermediate rotational body 33 in internal contact with the second rotational body 35. Accordingly, a local frictional force is generated at point P2 to hinder the sliding motion of the second rotational body 35 on the intermediate rotational body 33.

The local frictional force may be described as follows. Let us denote by F the force acting in the longitudinal direction of the radial guides 38, by θ (hereinafter referred to as frictional angle) the angle between the axis L4 and the radius R of the second rotational body 35 (centered at the rotational axis L1) passing through the point P2, and by μ the friction coefficient of the frictional surface involved. Then, as shown in FIG. 12 (*b*), the torque, that is generated in the rotational motion of the second rotational body 35 relative to intermediate rotational body 33 and may cause a difference in phase angle between the intermediate rotational body 33 and first the rotational body 31, equals F sin θ, while the local frictional force that hinders the sliding motion of the second rotational body 35 on the intermediate rotational body 33 is μF cos θ. Thus, if the frictional force exceeds sin θ, the reactive rotation of the second rotational body 35 relative to the intermediate rotational body 33 will not occur and hence no angular phase difference will take place. Accordingly, if the frictional angle θ is set to satisfy $F \sin\theta < \mu F \cos\theta$, or $\theta < \tan^{-1}\mu$, an unanticipated difference in phase angle of the camshaft 30 with respect to the first rotational body 31 will be prevented by the self-lock mechanism.

It is noted that the frictional angle θ decreases with the eccentric distance d3 which is the distance from the eccentric center L2 of the second circular eccentric cam 54 to the axis L4. The distance d3 decreases in proportion to the eccentric distance d1 from the eccentric center L2 to the rotational axis L1. As a consequence, the local frictional force of the self-lock mechanism can be enhanced by setting the eccentric distance d2 of the first circular eccentric cam 53 large to increase the maximum phase angle of the camshaft 30 relative to the first rotational body 31, and setting the eccentric distance d1 of the second circular eccentric cam 54 as small as possible.

In the first embodiment, the torque means of the second rotational body 35 consists essentially of the electromagnetic clutch 34 and the torsion coil spring 59. However, the torque means may be an electric motor, for example, that can directly control the second rotational body 35. Although the cam guide plate 37 of the first embodiment is rotated by the guide pins 44 through 47 in contact therewith, the guide pins 44 through 47 may be omitted by arranging the slide pins 40 in slidable contact with the radial guides 38 of the second rotational body 35.

Referring to FIGS. 13 through 17, the phase variable device in accordance with the second embodiment of the invention will now be described. In the second embodiment, the torsion coil spring 59 of the first embodiment is replaced by a second electromagnetic clutch mechanism 61 to vary phase angle in the reverse direction relative to that caused by the electromagnetic clutch 34. The structures of the components 35 through 43 of the torque means shown in FIG. 13 are the same as those of the first embodiment, except that the circular eccentric cam 36 and cam guide plate 37 are the arranged in a different way in connection with the intermediate rotational body 33, as described later, and that the leading end of the center shaft 32 is partly modified.

In the second embodiment, the second electromagnetic clutch mechanism 61 comprises a roller guide plate 62, a multiplicity of rollers 63 adapted to roll in engagement holes 62*a*, a third rotational body 64, a thrust bearing 65, a disc spring 66, a spring holder 67, and a second electromagnetic clutch 68, all arranged forwardly of the second rotational body 35. The roller guide plate 62 is immovably fixed to the flat section 32*f* of the center shaft 32 inserted in the square hole 62*b* of the roller guide plate 62. The second rotational body 35, roller guide plate 62, and third rotational body 64 are axially spaced apart along the axis of the center shaft 32, and rollers 63 is held in between the front end 35*c* of the second rotational body and the rear end 64*a* of the third rotational body 64 such that it is forced to roll in the roller guide plate 62 by the torque, if generated, in either the second or third rotational body. The third rotational body 64 is rotatably mounted on the leading end of the center shaft 32 by means of the thrust bearing 65 mounted in a recess 64*b*. The disc spring 66 is mounted forwardly of the thrust bearing 65, and the spring holder 67 is mounted forwardly of the disc spring 66. They are tightly fastened onto the center shaft 32 by a bolt 60. The thrust bearing 66 pushes the third rotational body 64 axially rearward via the thrust bearing 65 to secure rolling of rollers 63 between the third and second rotational bodies 64 and 35, respectively. The second electromagnetic clutch 68 is fixed to the engine casing (not shown) at a position adjacent the third rotational body 64.

In the second embodiment, the first circular eccentric cam 53 and cam guide plate 37 are arranged in association with the inner circumferential face 33*d* of the intermediate rotational body 33, as shown in FIG. 17. Under the initial condition, the upper end 37*d* of the cam guide plate 37 is in contact with the upper portion of the inner circumferential face 33*d* of the intermediate rotational body 33, while the central axis L3 (passing through the eccentric center of the first eccentric cam 53) is inclined clockwise with respect to the upward longitudinal axis L4 of radial guides 38.

Since the third rotational body 64, rollers 63, and roller guide plate 62 initially have no phase difference, they are rotated together with the second rotational body 35 by the first rotational body 31 in the same direction as the first rotational body 31. To change the phase angle of the camshaft 30 relative to the first rotational body 31, the second electromagnetic clutch 68 is energized. Then the third rotational body 64 is rotated counterclockwise relative to the second rotational body 35, thereby rolling the rollers 63. The second rotational body 35 and first circular eccentric cam 53 are acted upon by a torque due to the rotation of the rollers 63, and rotate clockwise relative to the intermediate rotational body 33. The cam guide plate 37 is lowered by the first circular eccentric cam 53, and at the same time the slide pins 40 are displaced along the skewed guides 39. The intermediate rotational body 33 is then coupled to the cam guide plate 37, and rotates clockwise relative to the first rotational body 31, thereby displacing the first rotational body 31 in the angularly advanced direction (clockwise) relative to the camshaft 30.

To reverse the phase angle of the camshaft 30 relative to the first rotational body 31 in the angularly delayed direction (counterclockwise), the electromagnetic clutch 34 is energized. Then, the second rotational body 35 and first circular eccentric cam 53 are then rotated counterclockwise relative to the intermediate rotational body 33, thereby lifting upward the cam guide plate 37 and delaying the phase angle of the first rotational body 31 of the camshaft 30. If the torsion coil spring 59 is replaced by the second electromagnetic clutch mechanism 61, the electromagnetic clutch 34 requires less torque since it needs not overcome the spring force of the torsion coil spring 59 then, so that it can be miniaturized. Further, it can be turned off to save energy after a required phase angle is obtained.

Referring to FIG. 18, a modification of the cam guide plate 37 for use in the foregoing examples will be described. In this modification, one of the slide pins 40 used in the foregoing examples, slide pin 69 say, is provided with an engagement section 69*a* adapted to rotate within the engagement hole 37*a* about its central axis 01 and with a slidable section 69*b* having a central axis 02 offset by a small distance away from the axis 01 so as to enable the slidable section 69*b* to undergo eccentric movement about the central axis 01. If the slide pin 69*b* is to be rotated eccentrically, the distance between the slide pin 40 and the slidable section 69*b* may be so adjusted in accordance with the distance between the pair of the skewed guides 39. Because of adjustability of the distance of the paired skewed guides and the distance between the slide pins 40 and 69, they have large manufacturing tolerance, which leads to better productivity of the device.

It is noted that in each of the examples shown above if the slide pin or pins 40 is (are) rotatably engaged in the respective engagement hole(s) 37*a*, or the slide pins 40 are replaced by rotatable spherical members, for example, protruding towards the radial guides 38 and skewed guides 39, relative phase angle between the intermediate rotational body 33 and the first rotational body 31 can be smoothly varied, since the slide members rotate in the guides 38 and 39.

BRIEF DESCRIPTION OF THE DRAWINGS

FIG. 10(*b*), a specification for achieving a phase angle variation in the angularly delayed direction; and FIG. 10(*c*), a specification for achieving a phase angle variation in both of the angularly advanced and delayed directions.

FIG. 12(*b*) a diagram describing the forces that acts on the second rotational body and the rotational guide plate at their contact point.

FIG. 18(*c*) shows a cross section taken along line E-E of FIG. 18(*b*); and FIG. 18(*d*) is an enlarged view of an eccentric slide pin.

LIST OF REFERENCE NUMERALS AND SYMBOLS

Figure 1:
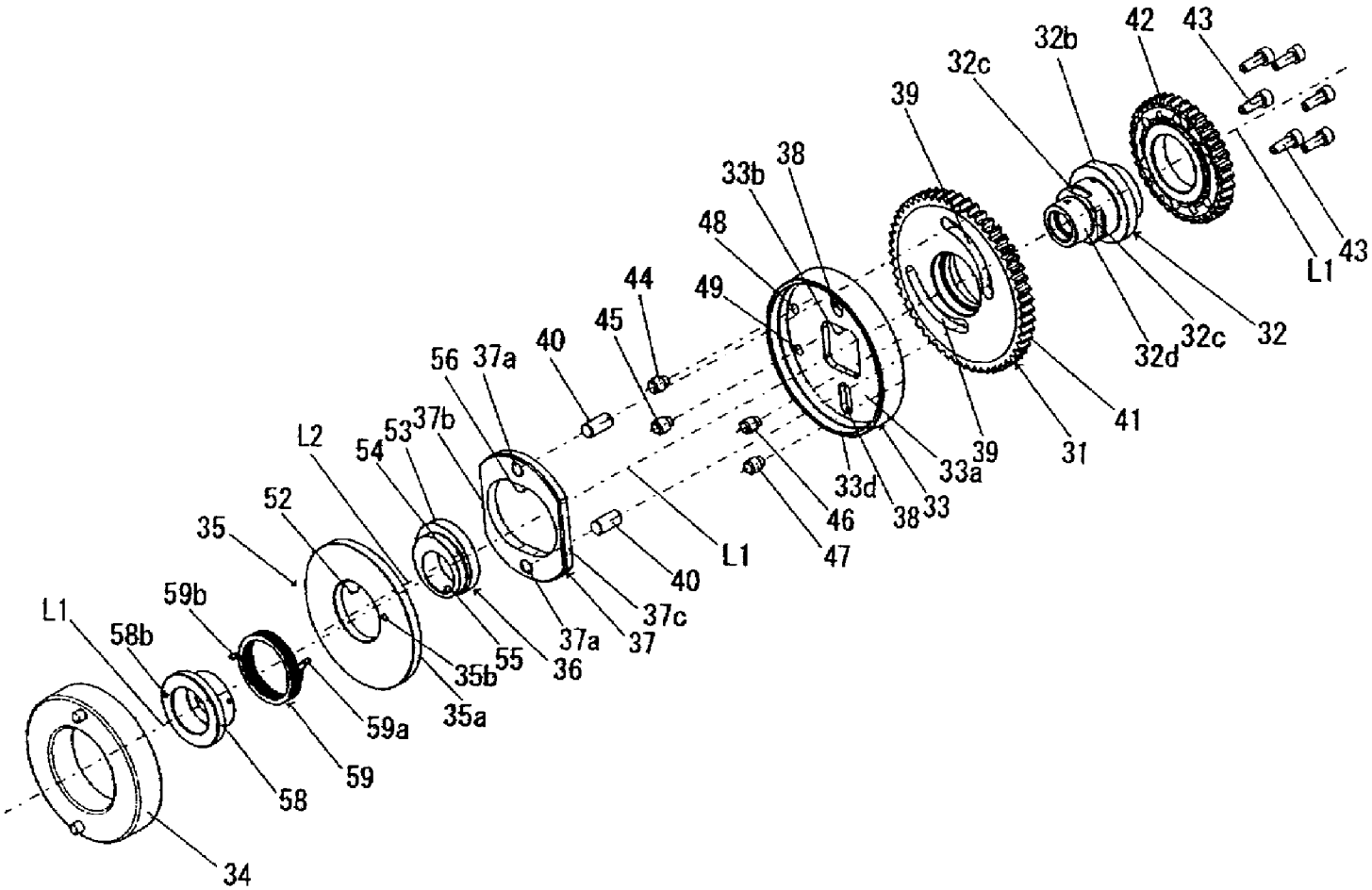
FIG. 1 shows an exploded perspective view of the phase variable device for use with a car engine in accordance with a first embodiment of the invention.
Figure 2:
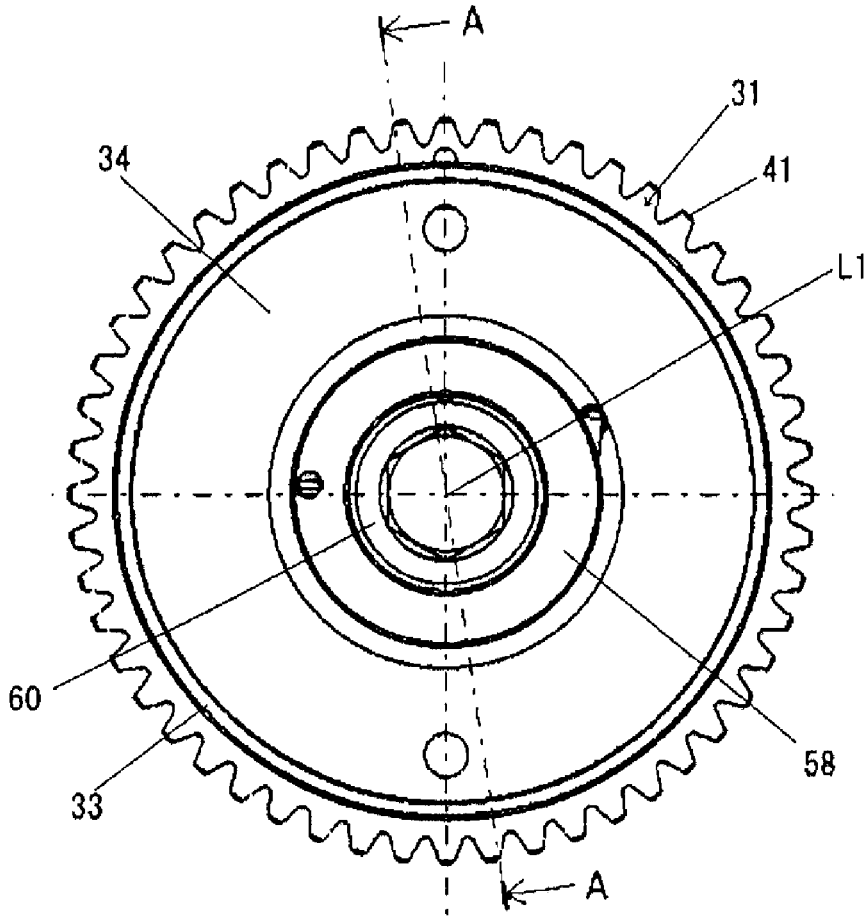
FIG. 2 shows a front view of the device of the first embodiment.
Figure 3:
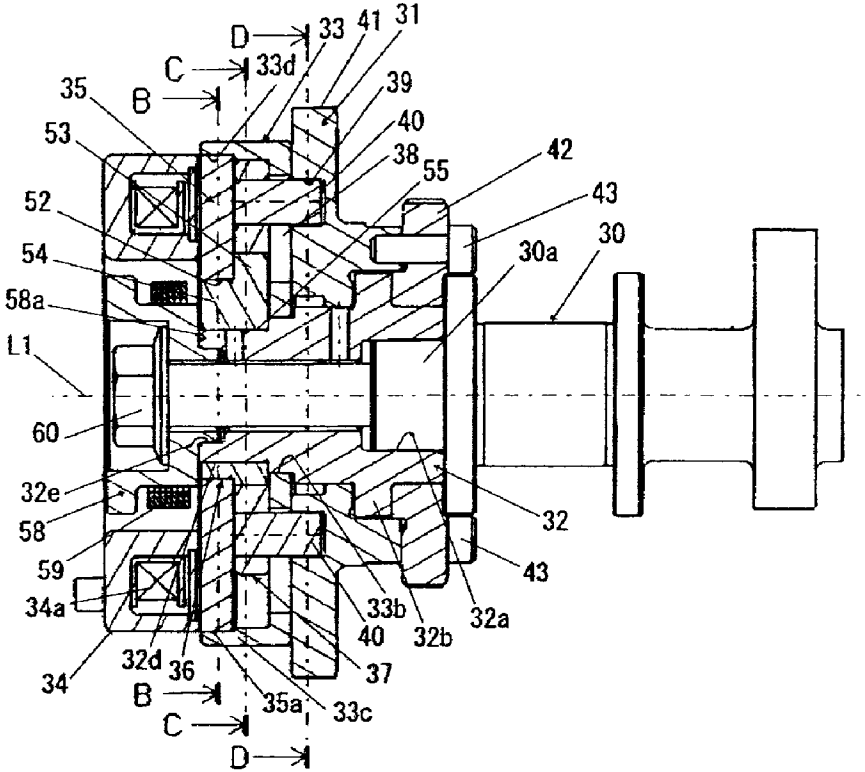
FIG. 3 shows an axial cross section of the first embodiment taken along line A-A of FIG. 1.
Figure 4:
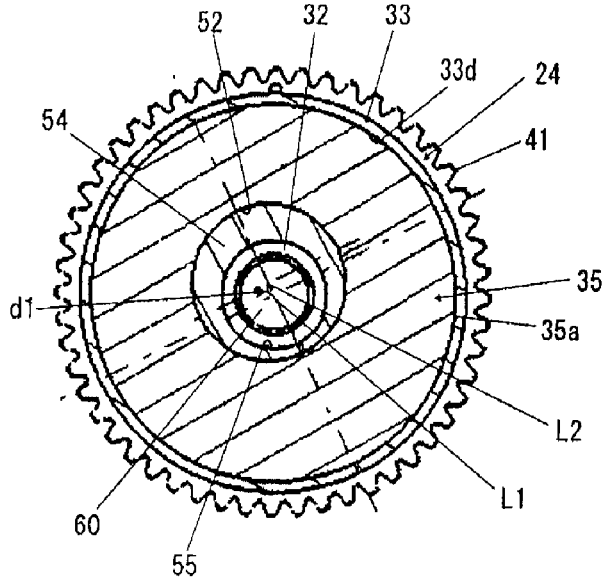
FIG. 4 shows vertical cross sections of the second rotational body and the rotational guide plate (intermediate rotational body), taken along line B-B of FIG. 3.
Figure 5:
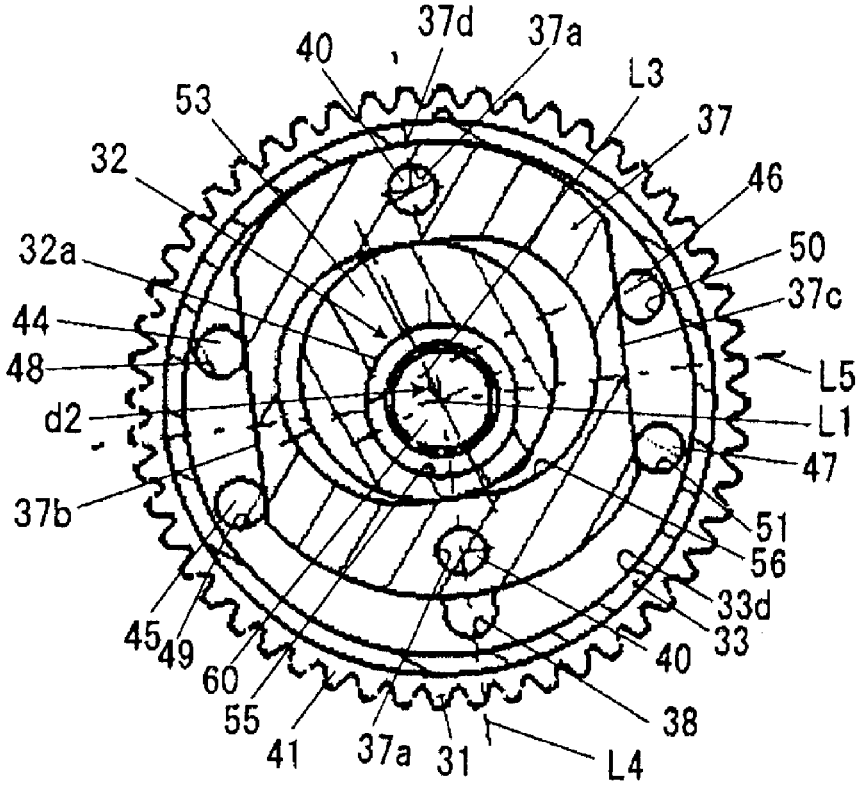
FIG. 5 shows cross sections of the cam guide plate and rotational guide plate, taken along line C-C of FIG. 3.
Figure 6:
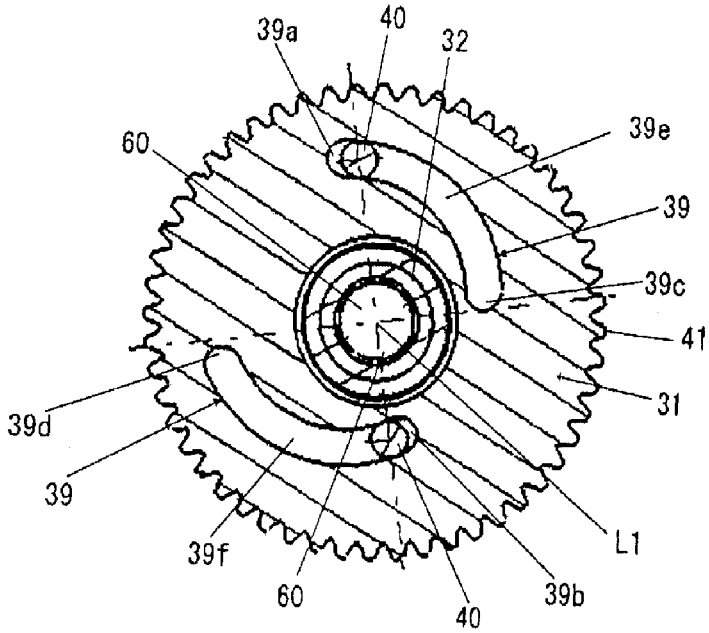
FIG. 6 shows a transverse cross section of the first rotational body taken along line D-D of FIG. 3.
Figure 7:
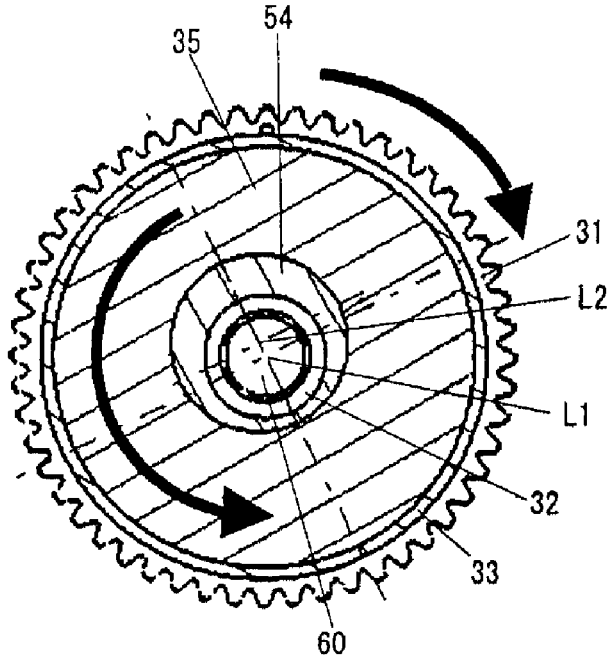
FIG. 7 is a diagram showing the operational relationship between the second rotational body and the circular eccentric cam.
Figure 8:
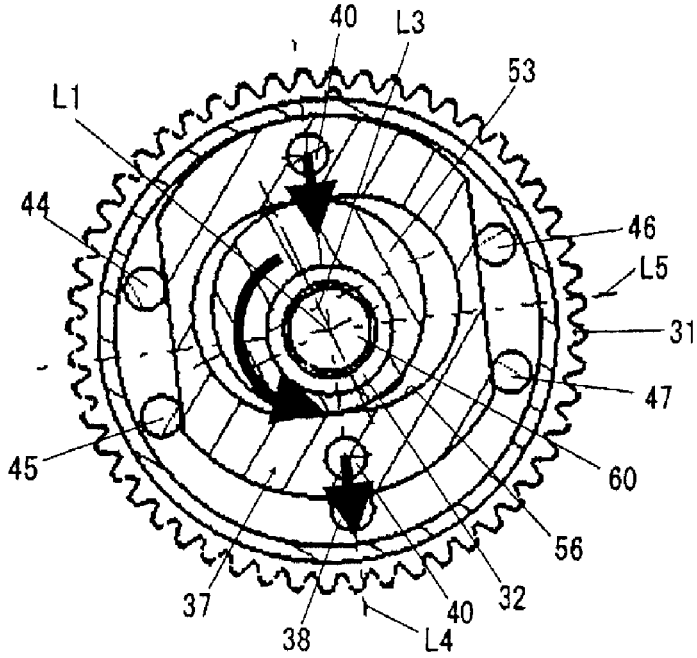
FIG. 8 is a diagram showing the operational relationship between the circular eccentric cam and the cam guide plate.
Figure 9:
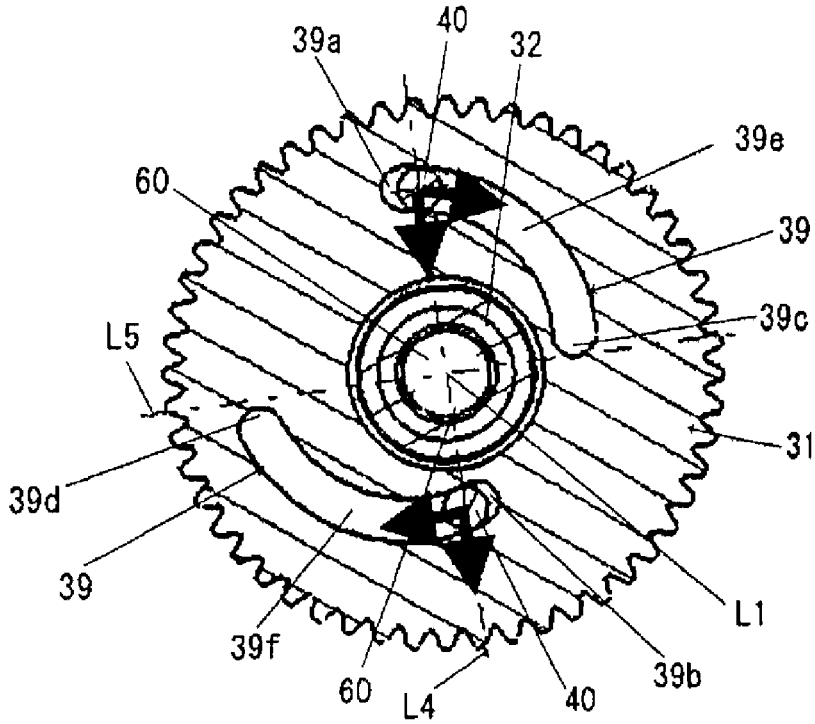
FIG. 9 is a diagram showing the operation of the slide member relative to the first rotational body.
Figure 10:
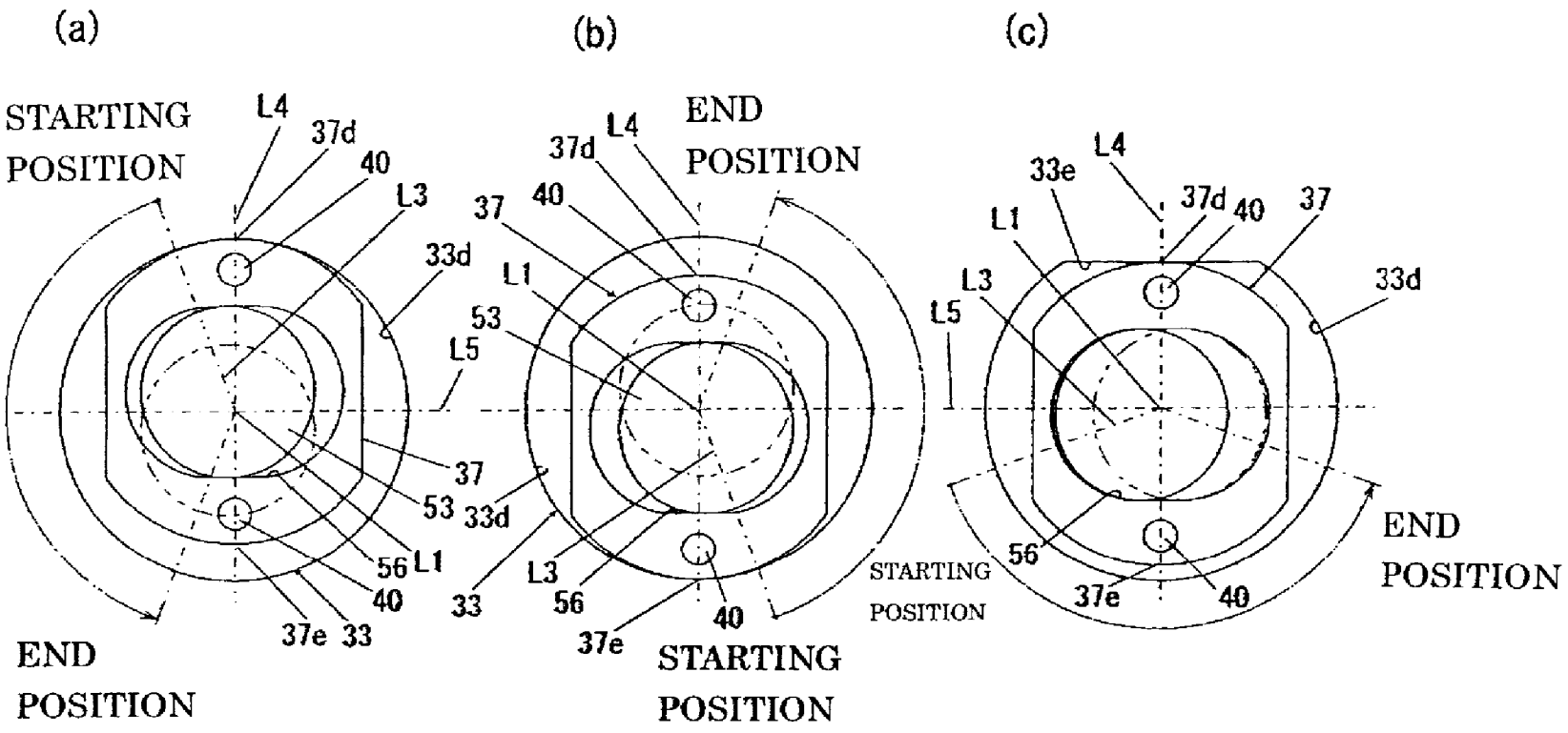
FIGS. 10(*a*) to (*c*) show different specifications of circular eccentric cams rotatable in different ranges on the plane of rotation. More particularly, FIG. 10(*a*) shows a specification for achieving a phase angle variation in the angularly advanced direction.
Figure 11:
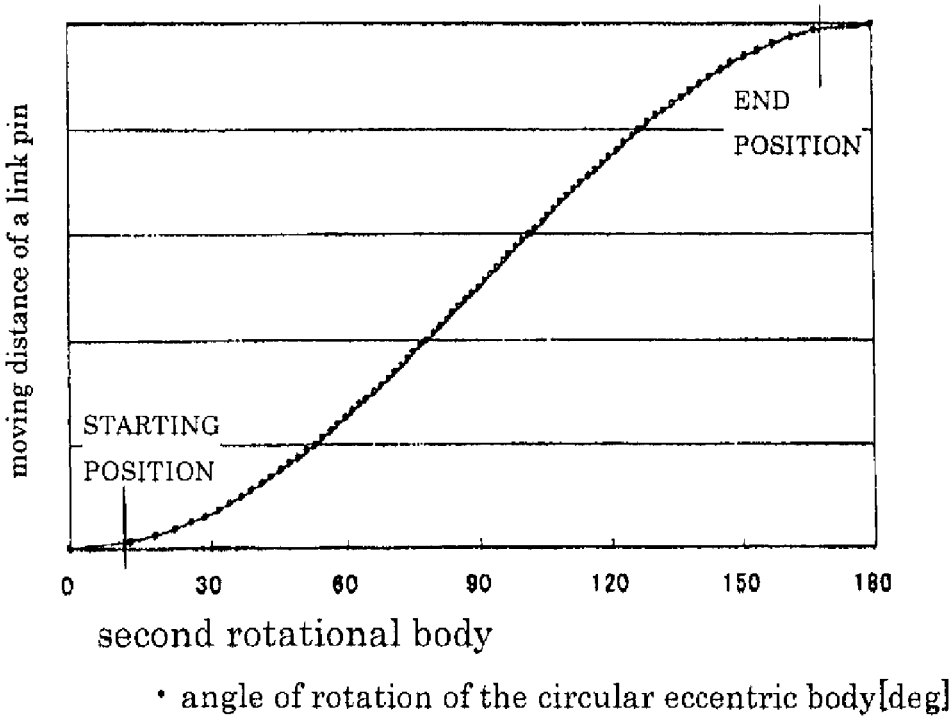
FIG. 11 is a graph showing the displacement of a slide member as a function of the angular position of the circular eccentric cam on the plane of rotation.
Figure 12:
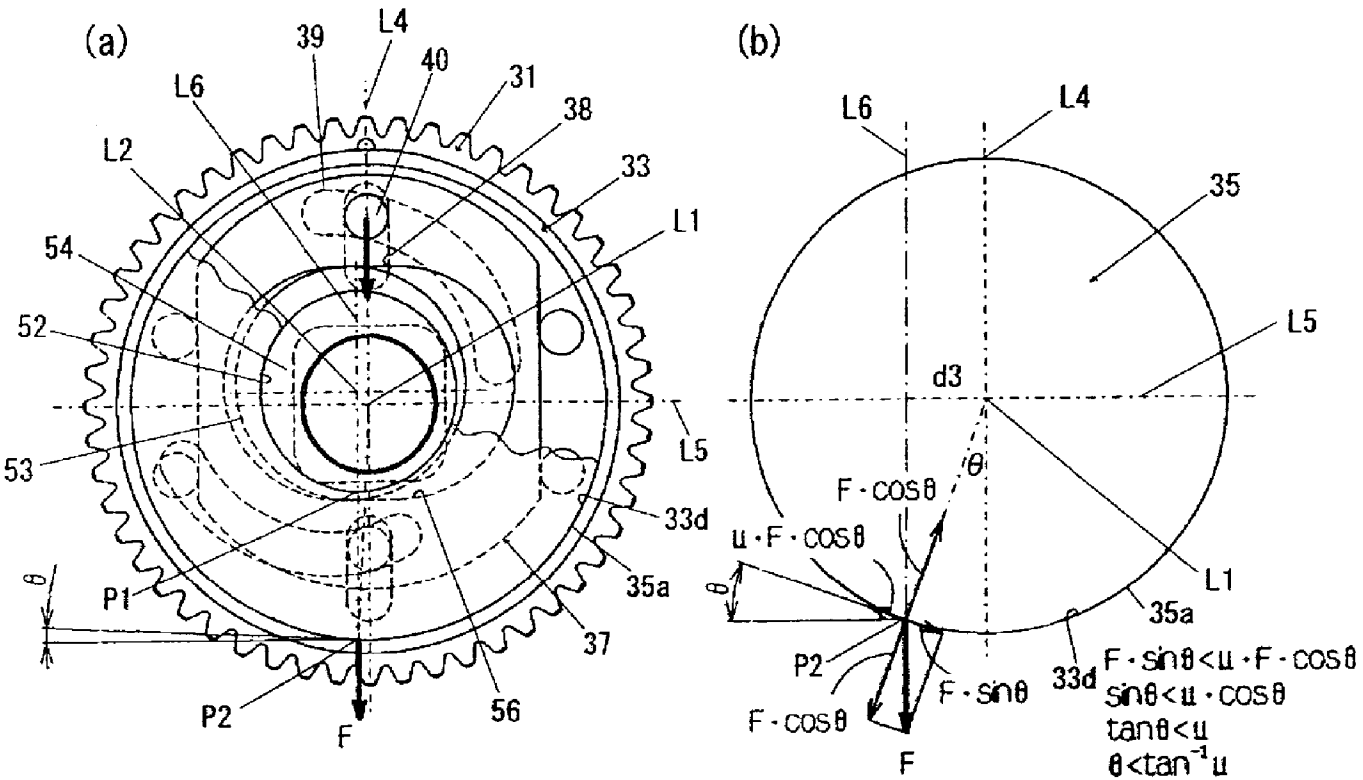
FIG. 12 is a diagram showing the structure of the self-lock mechanism comprising the second rotational body and rotational guide plate. More particularly, FIG. 12(*a*) shows the point of application of a force transmitted from the cam guide plate to the second rotational body.
Figure 13:
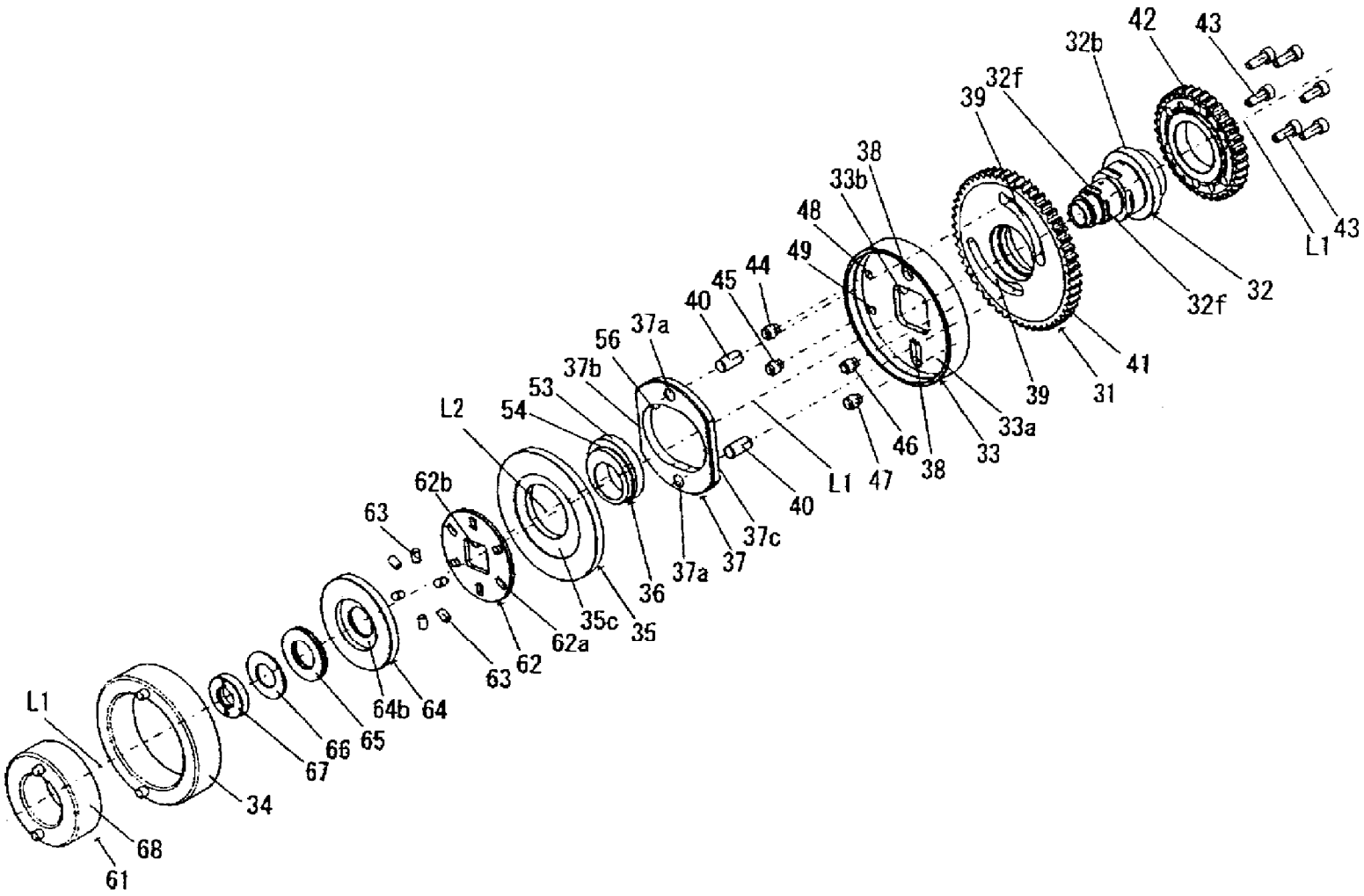
FIG. 13 is an exploded perspective view of the phase variable device for use with a car engine in accordance with the second embodiment of the invention.
Figure 14:
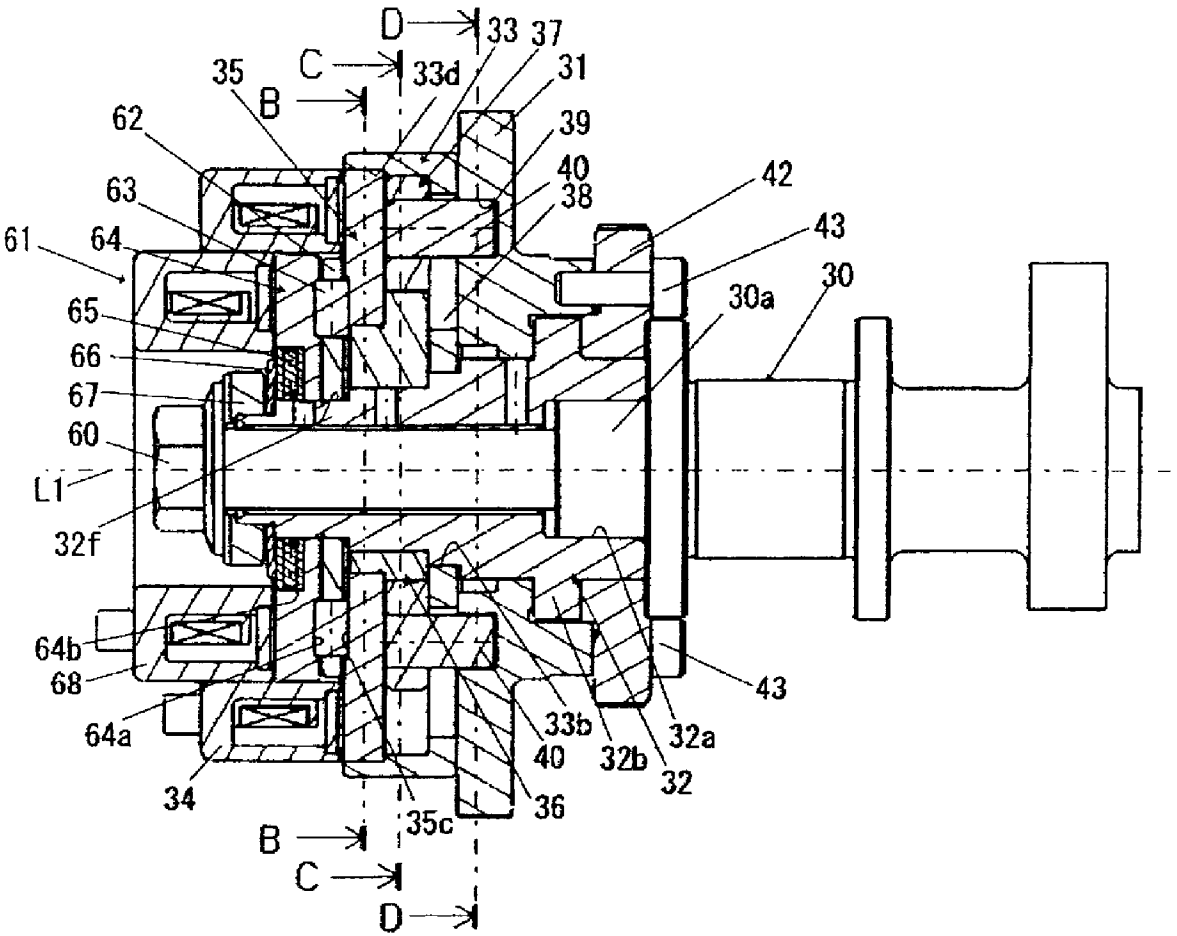
FIG. 14 shows an axial cross section of the second embodiment.
Figure 15:
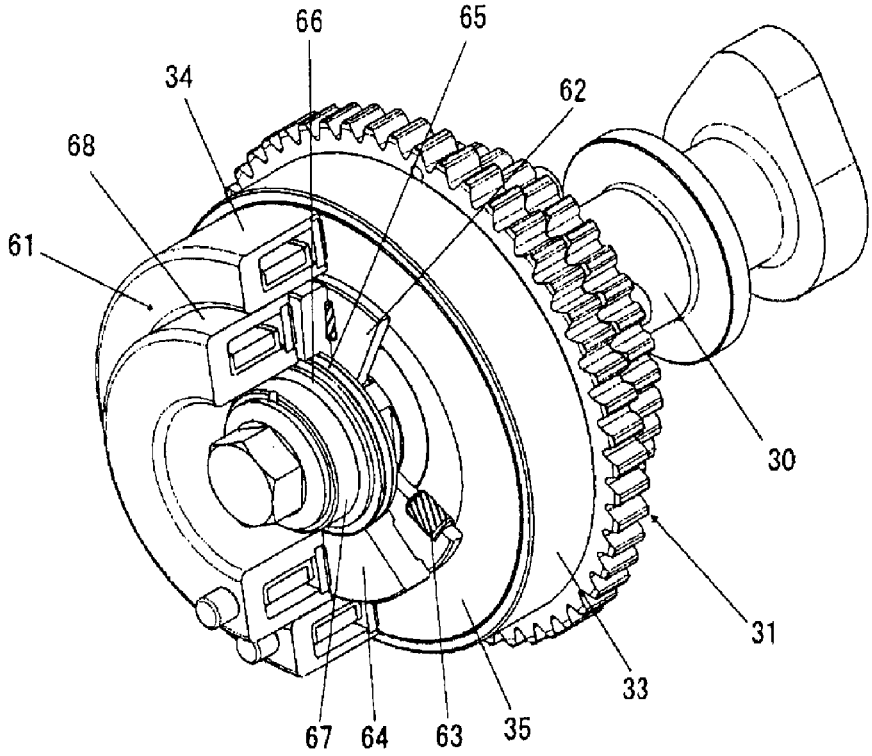
FIG. 15 shows in perspective, partly in cross section, the device in accordance with the second embodiment.
Figure 16:
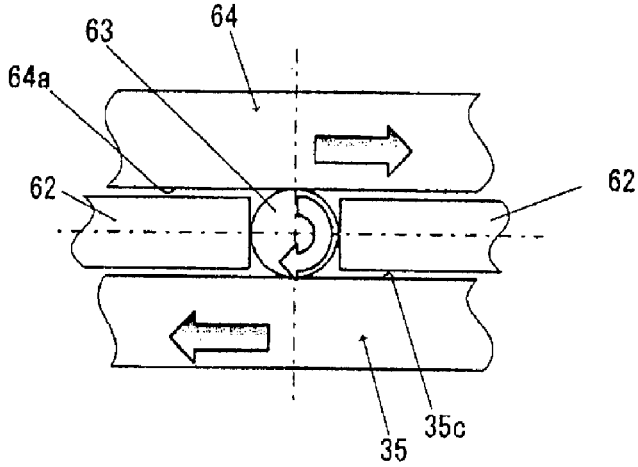
FIG. 16 shows the structures of the second rotational body and third rotational body in accordance with the second embodiment.
Figure 17:
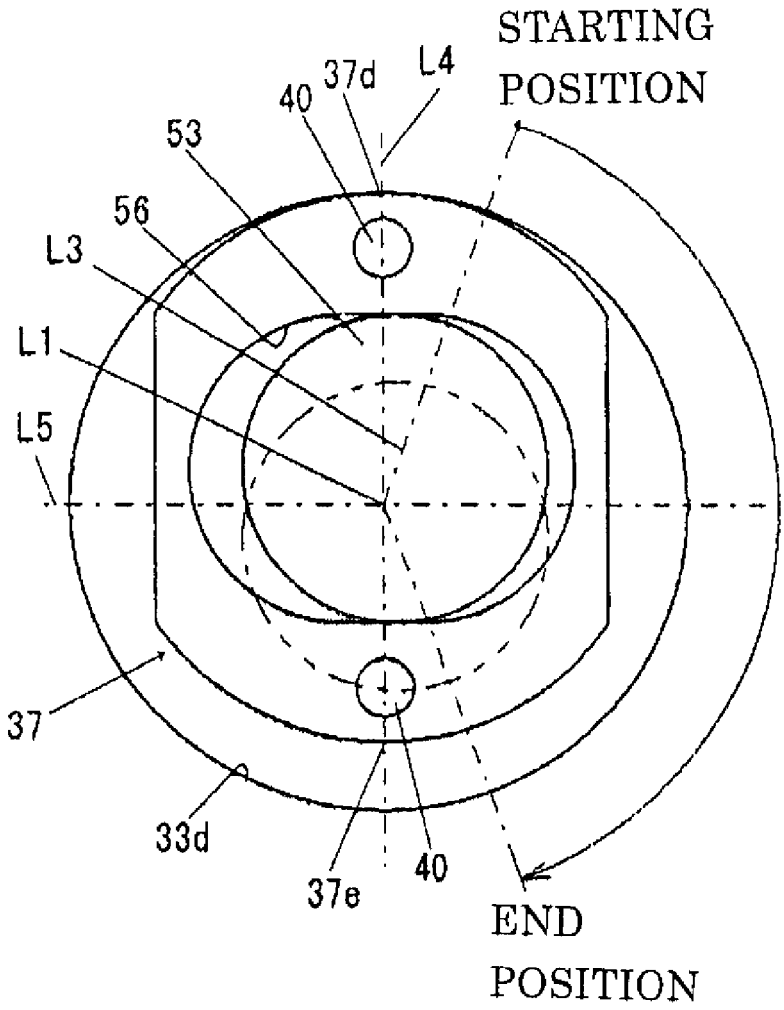
FIG. 17 shows arrangement of the circular eccentric cam and cam guide plate relative to the intermediate rotational body.
Figure 18:
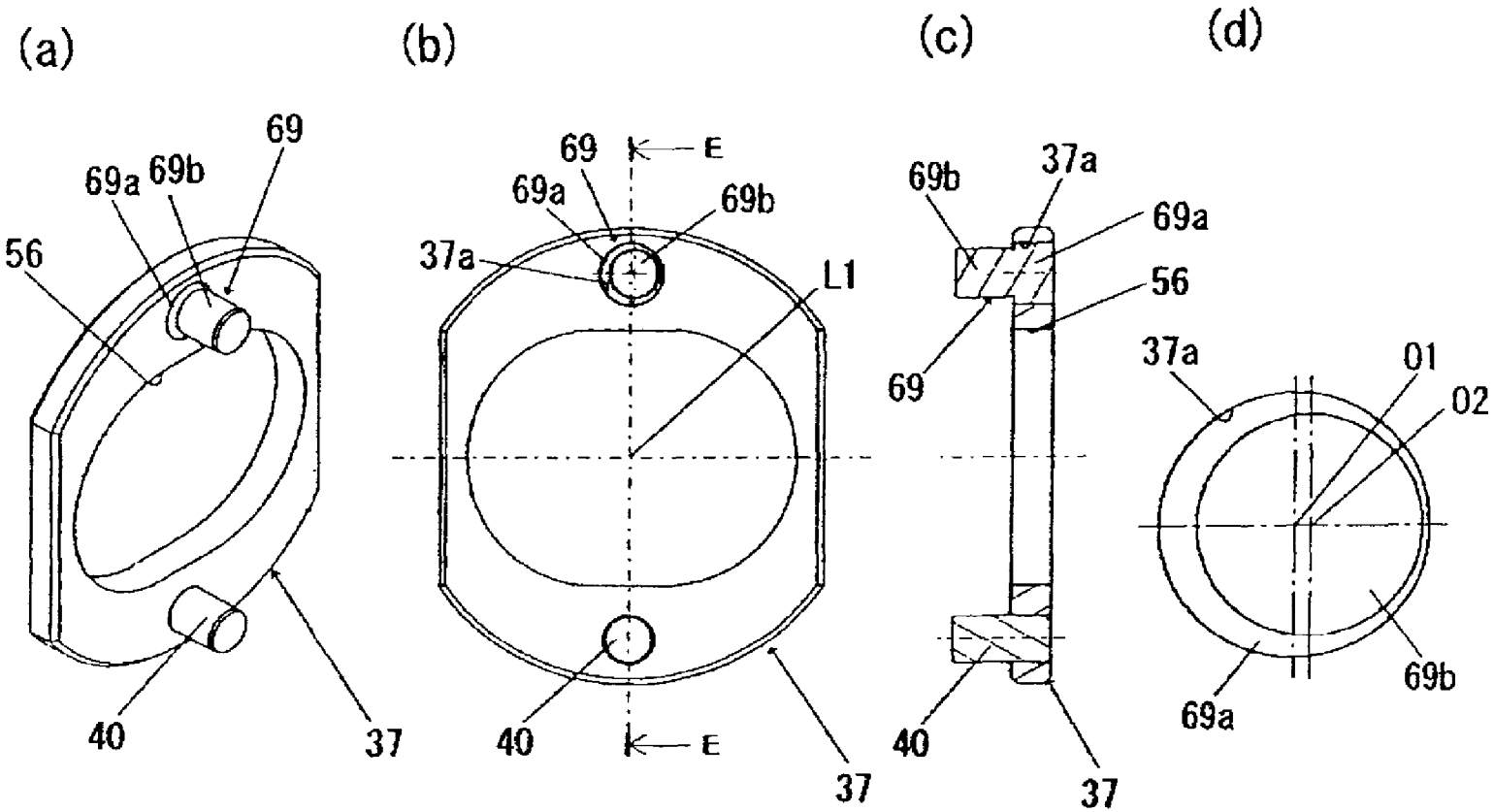
FIGS. 18(*a*) to (*d*) show views of a modification of the cam guide plate. More particularly, FIGS. 18(*a*) and (*b*) are a perspective view and a front view, respectively, of the modification.

30 camshaft
31 first rotational body (sprocket)
33 intermediate rotational body (rotational guide plate)
34 electromagnetic clutch
35 second rotational body
36 circular eccentric cam
37 cam guide plate
38 radial guides of the intermediate rotational body
39 skewed guides of the first rotational body
51 skewed guides of the second rotational body
53 first circular eccentric cam
54 second circular eccentric cam of the second rotational body
59 torsion coil spring
61 second electromagnetic clutch mechanism L1 rotational axis
L2 central axis of the second circular eccentric cam
L3 central axis of the first circular eccentric cam
d1 offset distance between L1 and L2 (eccentric distance of the second circular eccentric cam)
d2 offset distance between L1 and L3 (eccentric distance of the first circular eccentric cam)

The invention claimed is:

1. A phase variable device for use with a car engine having a phase angle varying mechanism which includes:

a first rotational body driven by the crankshaft of the engine;

an intermediate rotational body integral with the camshaft of the engine;

a second rotational body arranged forwardly of the intermediate rotational body; and torque means, arranged between the first and second rotational bodies, for providing the second rotational body with a torque to rotate the second rotational body relative to the first rotational body to change the phase angle of the first rotational body relative to the second rotational body, all the three bodies being coaxial with the same rotational axis and each being capable of undergoing relative rotational motion with respect to others, the phase angle varying mechanism is characterized in that:

the intermediate rotational body has a hollow cylindrical portion;

the second rotational body is disk-shaped and has substantially the same diameter as the inner diameter of the cylindrical portion of the intermediate rotational body, and is in contact with the inside of the cylindrical portion, the phase angle varying mechanism is characterized by further comprising:

a circular eccentric cam having a central axis offset from the rotational axis of the second rotational body and protruding in the direction from the second rotational body to the intermediate rotational body;

an oblong bore extending in the direction perpendicular to the rotational axis of the second rotational body to allow the circular eccentric cam to slide therein;

a cam guide plate having sliding members that extend therefrom towards the first rotational body and intermediate rotational body;

a pair of radial guides formed in the intermediate rotational body, each extending in the direction perpendicular to the longest diameter of the oblong bore of the cam guide plate; and skewed guides formed in the first rotational body, the guides skewed at an angle to the circumferential envelope of the first rotational body centered at the rotational axis of the first rotational body, so that the sliding members of the cam guide plate can move in the radial guides and the respective skewed guides.

2. The phase variable device according to claim 1, wherein the second rotational body has a circular eccentric bore having a center thereof being offset from the rotational axis of the second rotational body;

the circular eccentric cam comprises a first circular eccentric cams adapted to be in sliding contact with the oblong bore of the cam guide plate and a second circular eccentric cam formed adjacent the first circular eccentric cam and adapted to engage the circular eccentric bore;

the second circular eccentric cam is configured to have a central axis offset from the rotational axis of the second rotational body by a distance less than the distance between the axes of the first circular eccentric cam and the second rotational body.

* * * * *